US012221747B2

(12) United States Patent
Zhang et al.

(10) Patent No.: US 12,221,747 B2
(45) Date of Patent: Feb. 11, 2025

(54) METHOD FOR SEPARATING BIOMASS COMPONENTS BY TERNARY SYSTEM

(71) Applicant: Qilu University of Technology, Jinan (CN)

(72) Inventors: Yongchao Zhang, Jinan (CN); Menghua Qin, Jinan (CN); Yingjuan Fu, Jinan (CN)

(73) Assignee: Qilu University of Technology, Jinan (CN)

( * ) Notice: Subject to any disclaimer, the term of this patent is extended or adjusted under 35 U.S.C. 154(b) by 184 days.

(21) Appl. No.: 17/978,444

(22) Filed: Nov. 1, 2022

(65) Prior Publication Data

US 2023/0323597 A1 Oct. 12, 2023

(30) Foreign Application Priority Data

Mar. 22, 2022 (CN) ..... 202210281230.4

(51) Int. Cl.

| | |
|---|---|
| ***D21C 3/20*** | (2006.01) |
| ***D21C 3/00*** | (2006.01) |
| ***D21C 3/04*** | (2006.01) |
| ***D21C 3/22*** | (2006.01) |
| ***D21C 5/00*** | (2006.01) |
| ***D21C 9/16*** | (2006.01) |
| ***D21C 11/10*** | (2006.01) |

(52) U.S. Cl.

CPC ..... *D21C 3/20* (2013.01); *D21C 3/003* (2013.01); *D21C 3/04* (2013.01); *D21C 3/222* (2013.01); *D21C 5/00* (2013.01); *D21C 9/163* (2013.01); *D21C 11/10* (2013.01)

(58) Field of Classification Search

CPC ... D21C 1/04; D21C 3/04; D21C 3/20; D21C 3/222; D21C 3/0003; D21C 3/003

See application file for complete search history.

(56) References Cited

U.S. PATENT DOCUMENTS

2014/0200335 A1* 7/2014 Olkowski ..... B01J 23/8892 423/632
2016/0326694 A1* 11/2016 Blanc ..... D21C 9/163

FOREIGN PATENT DOCUMENTS

CN 110230228 A * 9/2019 ..... C07D 307/48

OTHER PUBLICATIONS

Millipore Sigma, Formic acid Data sheet, downloaded online Jun. 28, 2024 (Year: 2024).*
Millipore Sigma, Hydrogen peroxide Data sheet, downloaded online Jun. 28, 2024 (Year: 2024).*
English machine translation of CN110230228A, Sep. 2019. (Year: 2019).*

* cited by examiner

*Primary Examiner* — Anthony Calandra
(74) *Attorney, Agent, or Firm* — Hemisphere Law, PLLC; Zhigang Ma

(57) ABSTRACT

A method for separating biomass components by a ternary system, which relates to a technical field of biomass separation, and includes the following steps of: cooking and separating a biomass raw material by using a cooking liquor consisting of organic acid, small aromatic nucleophilic organic molecule and hydrogen peroxide to obtain solid residue and extracting solution, washing and screening the solid residue to obtain paper pulp, and separating and extracting lignin and/or hemicellulose from the extracting solution. This cooking system could effectively minimize the content of residual lignin and other compounds with chromophore groups in the obtained pulp, directly producing the high-whiteness pulp with excellent performance without additional bleaching process. In addition, the hemicellulose saccharides and high-activity lignin can be also obtained, so that the method has an important significance for realizing high value and industrialization of biomass resource utilization.

7 Claims, No Drawings

METHOD FOR SEPARATING BIOMASS COMPONENTS BY TERNARY SYSTEM

TECHNICAL FIELD

The invention relates to the field of biomass separation technologies, in particularly to a method for separating biomass components by a ternary system.

BACKGROUND

The biomass resource is a kind of renewable, environmentally friendly and inexpensive raw material, can be converted into energy, materials, chemicals and so on by different treatment methods, and has been regarded as an important choice to replace fossil resources. The biomass resource is of great significance to achieve the strategic goal of sustainable development.

The pulp and paper industry is a huge consumer of biomass resources. The existing pulping process mainly uses cellulose in raw materials, and the other two main components, hemicellulose and lignin, have not been fully separated and utilized. Moreover, the cellulose pulp obtained by the existing biomass separation method must undergo a complex bleaching process to obtain high-whiteness paper pulp meeting various application requirements. The bleaching process not only requires a large amount of chemicals, but also consumes a considerable part of energy and water, which is not in line with the concept of green chemical industry and biomass refining.

SUMMARY

Aiming at the problems of the prior art, the invention discloses a method for separating biomass components by a ternary system, which significantly reduces residual lignin and other compounds with chromophore groups in the cellulose pulp, can directly obtain high-whiteness paper pulp with excellent performance without an additional bleaching process, and can also obtain hemicellulose saccharides and high-activity lignin. It is of great significance to realize the high value and industrialization of biomass resource utilization.

The specific technical solution of the invention are as follows.

A method for separating biomass components by a ternary system, includes: cooking and separating a biomass raw material by using a cooking liquor consisting of organic acid, small aromatic nucleophilic organic molecule and hydrogen peroxide to obtain solid residue and extracting solution;

obtaining cellulose pulp by washing and screening the solid residue, i.e., directly obtaining high-whiteness pulp after the further washing and screening of the solid residue; and extracting highly active lignin and/or hemicellulose from the extracting solution.

Preferably, in the method for separating the biomass components by the ternary system, the organic acid is one or more selected from the group consisting of formic acid, acetic acid and oxalic acid.

Preferably, in method for separating biomass components by the ternary system, the small aromatic nucleophilic organic molecule is one or more selected from the group consisting of aniline, salicylic acid, benzoic acid, phenylacetic acid, phenol, cresol, catechol, resorcinol, phloroglucinol and naphthol.

Preferably, in the method for separating biomass components by the ternary system, a mass ratio of the organic acid, the small aromatic nucleophilic organic molecule and the hydrogen peroxide in the cooking liquor is (5-95):(5-95):(0-20), preferably (30-90):(5-50):(1-10), and more preferably (50-90):(10-50):(2-8).

Preferably, in the method for separating biomass components by the ternary system, a material-liquor mass ratio of the biomass raw material to the cooking liquor is 1:4-1:20, preferably 1:7-1:13, and more preferably 1:7-1:10.

Preferably, in the method for separating the biomass components by the ternary system, conditions of the cooking are as follows: a cooking temperature is 70-200 degree Celsius (° C.), cooking time is 5-300 minutes (min), and a heating rate is 1-5 degree Celsius per minute (° C./min). Wherein the cooking temperature is preferably 80-170° C., and more preferably 100-160° C.; the cooking time is preferably 10-240 min, and more preferably 30-120 min; and the heating rate is preferably 5° C./min.

Preferably, in the method for separating biomass components by the ternary system, reagents of the cooking liquor remaining in the extracting solution are recovered. Wherein the extracting solution can be used for recovering small organic molecules in the cooking liquor, for example, different small organic molecules are respectively obtained by a mode of multi-effect extractive distillation after vacuum evaporation.

Preferably, in the method for separating the biomass components by the ternary system, the lignin is extracted by the method of performing vacuum evaporation and concentration on the extracting solution and adding water for precipitation, and the hemicellulose dissolved in aqueous phase is dried and extracted. Wherein the extracting solution can be used for extracting the lignin and/or the hemicellulose saccharides, and the extraction method of the lignin and/or the hemicellulose saccharides can adopt the conventional extraction method, for example, after vacuum evaporation and concentration, water is added to generate a precipitate to obtain the lignin, and the hemicellulose saccharides dissolved in the water phase can be obtained after drying.

The invention further provides a cellulose pulp, which is obtained according to the above method for separating the biomass components by the ternary system.

The invention further provides an application of the above cellulose pulp. For example, the cellulose pulp is used for papermaking, and the high-whiteness paper pulp with excellent performance can be obtained.

The beneficial effects of the invention are as follows:

Accord to the method for separating the biomass components by the ternary system, the organic acid in the cooking liquor is utilized to remove the lignin in the biomass raw material and degrade the hemicellulose, and simultaneously, the hydrogen peroxide is utilized to remove the lignin and other compounds with chromophore groups on the fiber surface, so that the whiteness of the raw cellulose pulp can be improved. In addition, the small aromatic nucleophilic organic molecule is utilized to prevent the removed lignin from having condensation reaction with the lignin which is not removed from the surface of the biomass raw material in an acid environment, so as to avoid the condensed lignin macromolecules from depositing on the surface of the biomass raw material to form steric hindrance and prevent the lignin and hemicellulose on the raw material from being further degraded and dissolved out, simultaneously, the small aromatic nucleophilic organic molecule effectively reduces the condensation among the lignin macromolecules and reduces the molecular weight of the lignin, so that the lignin is easier to be dissolve out of plant cell walls, the removal efficiency of the lignin in the raw material can be improved, the residual amount of the lignin in cellulose solid after biomass separation can be reduced, and chromophore groups in the cellulose pulp can be further reduced, the whiteness of the cellulose pulp can be further improved without an additional bleaching process, and hemicellulose saccharides and high-activity lignin can be obtained by the biomass separation, it is of great significance for realizing the high value and industrialization of biomass resource utilization.

DETAILED DESCRIPTION OF THE EMBODIMENTS

The biomass of the invention mainly refers to lignocellulose such as straws, trees and the like in the agroforestry production process, leftovers in agricultural product processing industry, forestry and agricultural residues and the like.

For example, the biomass raw material may include wood such as poplar, eucalyptus, pine, fir, acacia, etc.; non-wood fiber raw material such as bamboo, straw, wheat straw, corn straw, etc.; vegetable straw such as eggplant, pepper, etc.

The small aromatic nucleophilic organic molecule of the invention can be understood as the organic matter having a single benzene ring structure and having unshared electron pairs at the ortho or para positions of the functional groups on the benzene ring.

The invention will be further described below with reference to the accompanying drawings and specific embodiments, so that those skilled in the art can better understand and implement the invention, but the embodiments are not intended to limit the invention.

The invention provides a method for separating biomass components by a ternary system, which includes the following steps of: cooking and separating a biomass raw material by using a cooking liquor consisting of organic acid, small aromatic nucleophilic organic molecule and hydrogen peroxide to obtain solid residue and extracting solution;

obtaining cellulose pulp by washing and screening the solid residue; and extracting lignin and/or hemicellulose from the extracting solution.

Raw cellulose pulp with obviously improved whiteness is obtained by the method, the purity of the cellulose is higher, the method improves the extraction rate of the lignin in the raw material, the obtained lignin and hemicellulose are beneficial to subsequent comprehensive and effective high-valued utilization of biomass, and the method has simple operation flow and low production cost, No other inorganic acid, inorganic salt and metal ion are introduced, and the obtain products are relatively pure and are very suitable for industrial production.

In particular applications, some embodiments of the method of the invention are illustrated. Please refer to table 1 for the materials and reaction conditions used in the embodiments. Unless otherwise specified, the content of each component used in the following materials is the mass percentage content.

TABLE 1

| | material | | | | | |
|---|---|---|---|---|---|---|
| | | Reaction conditions | | Cooking reagents | | |
| consumption | Raw material (absolutely dry, g) | temperature (° C.) | time (h) | 85% Organic acid solution (g) | Small aromatic nucleophilic organic molecule (g) | 35% hydrogen peroxide (g) |
| Comparative embodiment 1 | Neosinocalamus affinis bamboo strips 100 | 120 | 2 | Formic acid: 1000 | 0 | 0 |
| Comparative embodiment 1 | Neosinocalamus affinis bamboo strips 100 | 120 | 2 | Formic acid: 975 | 0 | 25 |
| Proportioning embodiment 1 | Neosinocalamus affinis bamboo strips 100 | 120 | 2 | Formic acid: 700 | Salicylic acid: 300 | 0 |
| Proportioning embodiment 2 | Neosinocalamus affinis bamboo strips 100 | 130 | 3 | Formic acid: 650 | Salicylic acid: 330 | 20 |
| Proportioning embodiment 3 | Neosinocalamus affinis bamboo strips 100 | 110 | 4 | Acetic acid: 650 | Salicylic acid: 330 | 30 |
| Proportioning embodiment 4 | Neosinocalamus affinis bamboo strips 100 | 140 | 0.5 | Formic acid: 700 | Cresol: 280 | 25 |
| Proportioning embodiment 5 | Neosinocalamus affinis bamboo strips 100 | 120 | 2 | Formic acid: 650 | Benzoic acid: 330 | 20 |
| Proportioning embodiment 6 | Neosinocalamus affinis bamboo strips 100 | 120 | 2 | Formic acid: 700 | Phenol: 280 | 20 |
| Proportioning embodiment 7 | Pine wood chips 100 | 130 | 2 | Formic acid: 800 | Cresol: 180 | 20 |
| Proportioning embodiment 8 | Poplar wood chips 100 | 110 | 3 | Formic acid: 800 | Salicylic acid: 180 | 20 |
| Proportioning | Corn straws 100 | 110 | 2 | Formic acid: 800 | Salicylic acid: 180 | 20 |

TABLE 1-continued

| | material | | | | | |
|---|---|---|---|---|---|---|
| | | Reaction conditions | | Cooking reagents | | |
| consumption | Raw material (absolutely dry, g) | temperature (° C.) | time (h) | 85% Organic acid solution (g) | Small aromatic nucleophilic organic molecule (g) | 35% hydrogen peroxide (g) |
| embodiment 9 | | | | | | |
| Proportioning embodiment 10 | Poplar wood chips 100 | 110 | 3 | Formic acid: 800 | Salicylic acid 90 Phenylacetic acid 90 | 20 |
| Proportioning embodiment 11 | Poplar wood chips 100 | 120 | 2 | Formic acid: 800 | Aniline: 180 | 20 |
| Proportioning embodiment 12 | Poplar wood chips 100 | 120 | 2 | Formic acid: 800 | Resorcinol: 180 | 20 |
| Proportioning embodiment 13 | Poplar wood chips 100 | 120 | 2 | Formic acid: 800 | Pyrogallol: 180 | 20 |
| Proportioning embodiment 14 | Poplar wood chips 100 | 120 | 2 | Formic acid: 1000 | Salicylic acid: 480 | 20 |

The biomass raw material can be chopped according to actual conditions, for example, wood chips and bamboo strips can be processed into sheets with the length and the width of 2.0-4.0 cm and the thickness of 0.5-1.0 cm.

A cooking container can be a Hastelloy C reaction kettle, which is heated by a heating jacket with programmed temperature control.

Cooking Process:

a. The cooking reagents and the raw material of the biomass with above formula contents are put into the reaction kettle to heat to a preset cooking temperature, and the timing is started to complete a certain cooking time, and the heating rate in the heating process is 1-5.0° C./min and can be properly adjusted;

b. After the cooking is finished, the solid-liquid separation is carried out to obtain the solid residue and the extracting solution, the solid residue is washed and screened to obtain the cellulose pulp; and c. The cooking reagents, small organic molecules, saccharides, lignin, etc. can be recovered from the extracting solution. The method for recovering the lignin and the hemicellulose saccharides may include: performing vacuum evaporation and concentration and adding water for precipitation to obtain the lignin, and obtaining the hemicellulose saccharides dissolved in the water phase after being dried. The cooking reagents and the small organic molecules are respectively obtained by multi-effect extractive distillation after being subjected to vacuum evaporation, and are recycled.

The separated biomass components are tested and analyzed, referring to table 2.

TABLE 2

| | Item | | | | | |
|---|---|---|---|---|---|---|
| Sample | Cellulose pulp yield (%) | Kappa number | Whiteness (ISO %) | Lignin yield (%) | Hemicellulose total saccharide (%) | Lignin phenolic hydroxyl (mmol/g) |
| Comparative embodiment 1 | 48.1 | 43 | 25.3 | 19.5 | 8.9 | 1.9 |
| Comparative embodiment 2 | 46.5 | 31.5 | 33.5 | 20.3 | 8.6 | 1.8 |
| Proportioning embodiment 1 | 42.2 | 11 | 60.8 | 23.4 | 10.2 | 3.9 |
| Proportioning embodiment 2 | 40.5 | 5.3 | 73.5 | 22.6 | 11.6 | 3.5 |
| Proportioning embodiment 3 | 41.3 | 7.5 | 71.3 | 23.2 | 13.3 | 3.8 |
| Proportioning embodiment 4 | 42.0 | 6.7 | 74.6 | 22.5 | 12.8 | 3.2 |
| Proportioning embodiment 5 | 41.5 | 11.5 | 68.5 | 23.5 | 13.3 | 2.1 |
| Proportioning embodiment 6 | 41.2 | 9.2 | 67.5 | 23.7 | 12.3 | 3.8 |
| Proportioning embodiment 7 | 42.4 | 4.3 | 68.9 | 26.4 | 14.2 | 3.4 |
| Proportioning embodiment 8 | 41.1 | 3.2 | 79.0 | 26.3 | 13.1 | 3.3 |
| Proportioning embodiment 9 | 37.2 | 3.6 | 69.2 | 19.1 | 18.2 | 2.8 |
| Proportioning embodiment 10 | 40.5 | 3.5 | 78.5 | 25.4 | 12.6 | 3.3 |
| Proportioning embodiment 11 | 42.6 | 12.0 | 67.9 | 24.4 | 12.2 | 1.9 |
| Proportioning | 43.5 | 15.3 | 61.5 | 23.9 | 12.4 | 1.7 |

TABLE 2-continued

| Sample | Item | | | | | |
|---|---|---|---|---|---|---|
| | Cellulose pulp yield (%) | Kappa number | Whiteness (ISO %) | Lignin yield (%) | Hemicellulose total saccharide (%) | Lignin phenolic hydroxyl (mmol/g) |
| embodiment 12 Proportioning | 44.2 | 17.5 | 59.5 | 23.4 | 12.6 | 1.8 |
| embodiment 13 Proportioning | 39.1 | 2.7 | 81.6 | 27.8 | 12.6 | 3.1 |
| embodiment 14 | | | | | | |

The yield (GB/T 2677.2-1993), Kappa number (GB/T 1546-2004), viscosity (GB/T 1548-2004) and whiteness (GB/T 7974-2002) of the obtained pulp after the cooking were determined according to the national standard methods. The content of the hemicellulose in the cooking liquor is directly determined by ion chromatography, and the total value of monosaccharide content determined by the ion chromatography after drying and acidolysis of the extracting solution is the content of the hemicellulose. The content of the phenolic hydroxyl in the lignin was quantitatively analyzed by $^{31}P$ nuclear magnetic resonance (NMR).

Analysis of the test results in table 2 shows that the proportioning embodiments 1-14 in the table 2 all utilize the cooking liquor of the invention for biomass separation, and the comparative embodiments 1-2 utilize the biomass separation method of the prior art.

The yield of the cellulose pulp in the proportioning embodiments 1-14 is obviously lower than that in the comparative embodiments 1-2, and the yield of the lignin and the total saccharide of the hemicellulose in the proportioning embodiments 1-14 are obviously higher than that in the comparative embodiments 1-2. Combining the parameters of the three, it can be seen that the lignin and hemicellulose in the cellulose pulp are obviously reduced after the biomass is separated in the proportioning embodiments, so the yield of cellulose pulp is obviously reduced. The method obviously improve that removal of the lignin and the degradation of the hemicellulose in the materials.

The Kappa number of the proportioning embodiments 1-14 is significantly lower than that of the comparative embodiments 1-2, and the Kappa number represents the residual lignin content in the paper pulp, and the lower the value, the lower the lignin content.

The whiteness of the cellulose pulp in the proportioning embodiments 1-14 is obviously higher than that in the comparative embodiments 1-2, which shows that the method of the invention obviously improves the whiteness of the cellulose pulp and does not additionally increase a bleaching process.

The test results in the table 2 show that the method of the invention significantly improves the whiteness of the cellulose pulp and simultaneously improves the yield of lignin.

Biomass components mainly include cellulose, hemicellulose and lignin, in the separation process of the biomass components, the lignin is subject to an acidic degradation reaction in an acidic system, the hemicellulose is degraded and dissolved out in the form of oligosaccharides, and various chain bonds of the lignin are broken to different degrees to promote the degradation and dissolution of the lignin inside cell walls. The cellulose remains in the system as a solid. In the prior art, lignin molecular fragments (molecular weight is usually more than 2000) removed from the biomass raw material are dissolved in an acid reaction system, and are easy to generate intramolecular and intermolecular condensation reaction with lignin which is not separated from the biomass, and the condensed lignin macromolecules are deposited on the surface of the biomass raw material and form steric hindrance effect inside the raw material, it hinders the further degradation and dissolution of lignin and hemicellulose, the separation efficiency of the lignin is reduced, resulting in more lignin content in the biomass raw material solids, that is, the problem of high lignin content in cellulose pulp, and the chromophore groups in lignin lead to low whiteness of cellulose pulp.

The method of the invention utilize the small aromatic nucleophilic organic molecule to replace the degraded and dissolved lignin molecular fragments in the organic acid reaction system to react with active site carbocations in lignin molecules which are not separated from the biomass raw material and terminate active intermediate-carbocation of lignin, so as to block the intramolecular and intermolecular condensation reaction of the lignin, and promote the complete degradation and dissolution of the lignin from the biomass raw material, reduce the residual amount of the lignin in the cellulose solid, reduce the chromophore groups in the paper pulp, and further obviously improve the whiteness of the paper pulp.

It should be noted that, under the scope of the technical scheme of the invention, only some embodiments are listed above, and on the premise that the technical scheme of the invention can be implemented, the technical effect of the invention can be achieved by selecting to increase or decrease the amount of materials used and properly adjusting the implementation conditions within the scope of the technical scheme according to the requirements.

Other reagents used in the invention are reagents that can be purchased or prepared in the prior art, and will not be repeated.

The above embodiments are only preferred embodiments for fully explaining the invention, and the scope of protection of the invention is not limited thereto. Any equivalent substitution or change made by those skilled in the art on the basis of the invention is within the scope of protection of the invention. The scope of the invention is defined by the claims.

What is claimed is:

1. A method for separating biomass components by a ternary system, comprising:

heating organic acid, small aromatic nucleophilic organic molecule, hydrogen peroxide and a biomass raw material together to a cooking temperature of 70° C. to 200° C. with a heating rate with 1° C./min to 5° C./min, cooking the organic acid, the small aromatic nucleophilic organic molecule, the hydrogen peroxide and the biomass raw material at the cooking temperature of 70° C. to 200° C. for 5 min to 300 min to obtain a mixture, and separating the mixture to obtain solid residue and extracting solution; wherein the organic acid, the small aromatic nucleophilic organic molecule and the hydrogen peroxide together form cooking liquor, and a material-liquor mass ratio of the biomass raw material to the cooking liquor is 1:7-1:13;

directly obtaining pulp after further washing and screening of the solid residue; and extracting lignin and/or hemicellulose from the extracting solution.

2. The method for separating biomass components by the ternary system according to claim 1, wherein the organic acid is one or more selected from the group consisting of formic acid, acetic acid and oxalic acid.

3. The method for separating biomass components by the ternary system according to claim 1, wherein the small aromatic nucleophilic organic molecule is one or more selected from the group consisting of aniline, salicylic acid, benzoic acid, phenylacetic acid, phenol, cresol, catechol, resorcinol, phloroglucinol and naphthol.

4. The method for separating biomass components by the ternary system according to claim 1, wherein a mass ratio of the organic acid, the small aromatic nucleophilic organic molecule and the hydrogen peroxide in the cooking liquor is 30-90:5-50:1-10.

5. The method for separating biomass components by the ternary system according to claim 1, further comprising:

recovering reagents of the cooking liquor remaining in the extracting solution.

6. The method for separating biomass components by the ternary system according to claim 1, wherein the extracting lignin and/or hemicellulose from the extracting solution, comprises:

performing vacuum evaporation and concentration on the extracting solution, and then adding water into the extracting solution for precipitation to obtain the lignin; and drying and extracting the hemicellulose dissolved in aqueous phase.

7. A method for separating biomass components by a ternary system, comprising:

heating organic acid, small aromatic nucleophilic organic molecule, hydrogen peroxide and a biomass raw material together to a cooking temperature of 100° C. to 160° C. with a heating rate with 1° C./min to 5° C./min, then cooking the organic acid, the small aromatic nucleophilic organic molecule, the hydrogen peroxide and the biomass raw material at the cooking temperature for 30 min to 120 min to obtain a mixture, and separating the mixture to obtain solid residue and extracting solution; wherein the organic acid, the small aromatic nucleophilic organic molecule and the hydrogen peroxide together form cooking liquor, a mass ratio of the organic acid, the small aromatic nucleophilic organic molecule and the hydrogen peroxide in the cooking liquor is 50-90:10-50:2-8, and a material-liquor mass ratio of the biomass raw material to the cooking liquor is 1:7-1:10;

directly obtaining pulp after further washing and screening of the solid residue; and extracting lignin and/or hemicellulose from the extracting solution.

* * * * *